US011230906B2

(12) United States Patent
Palmer et al.

(10) Patent No.: US 11,230,906 B2
(45) Date of Patent: Jan. 25, 2022

(54) LOCKING BACKPRESSURE VALVE

(71) Applicants: Larry Thomas Palmer, Spring, TX (US); Erik Van Steveninck, Houston, TX (US); Steve Wilson, III, Magnolia, TX (US)

(72) Inventors: Larry Thomas Palmer, Spring, TX (US); Erik Van Steveninck, Houston, TX (US); Steve Wilson, III, Magnolia, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/889,858

(22) Filed: Jun. 2, 2020

(65) Prior Publication Data

US 2021/0372229 A1 Dec. 2, 2021

(51) Int. Cl.
*E21B 34/14* (2006.01)

(52) U.S. Cl.
CPC ..... *E21B 34/14* (2013.01); *E21B 2200/05* (2020.05)

(58) Field of Classification Search
CPC ..... E21B 34/14; E21B 2200/05; E21B 34/12
See application file for complete search history.

(56) References Cited

U.S. PATENT DOCUMENTS 3,289,693 A 12/1966 Scaramucci
3,376,935 A 4/1968 Baker
3,951,338 A 4/1976 Genna
3,958,633 A 5/1976 Britch et al.
4,033,429 A 7/1977 Farr
4,100,969 A 7/1978 Randermann, Jr.
4,220,206 A 9/1980 Van Winkle
4,393,930 A 7/1983 Ross et al.
4,407,329 A 10/1983 Huebsch et al.
4,474,241 A 10/1984 Freeman
4,566,541 A 1/1986 Moussy et al.
4,597,449 A 7/1986 Keeney
(Continued)

FOREIGN PATENT DOCUMENTS

CN 103410491 A 11/2013
CN 110173233 A 8/2019
(Continued)

OTHER PUBLICATIONS

International Search Report and Written Opinion for International Application No. PCT/US2019/026878; International Filing Date Apr. 11, 2019; Report dated Jul. 26, 2019 (pp. 1-8).
(Continued)

*Primary Examiner* — Michael R Wills, III
(74) *Attorney, Agent, or Firm* — Cantor Colburn LLP

(57) ABSTRACT

A downhole tool includes a tubular having an outer surface and an inner surface defining a flowbore having a longitudinal axis, and a backpressure valve cartridge arranged in the flowbore. The backpressure valve cartridge includes a valve seat and a flapper valve pivotally mounted relative to the valve seat. The backpressure valve cartridge is shiftable along the longitudinal axis to shift the flapper valve between a first position, wherein the flapper valve rests on the valve seat, and a second position, wherein the flapper valve is pivoted away from the valve seat.

19 Claims, 8 Drawing Sheets

(56) References Cited

U.S. PATENT DOCUMENTS

| | | | | |
|---|---|---|---|---|
| 4,676,307 | A | 6/1987 | Pringle | |
| 4,729,432 | A | 3/1988 | Helms | |
| 4,782,895 | A | 11/1988 | Jacob et al. | |
| 5,022,427 | A | 6/1991 | Churchman et al. | |
| 5,159,981 | A | 11/1992 | Le | |
| 5,496,044 | A | 3/1996 | Beall et al. | |
| 6,260,850 | B1 | 7/2001 | Beall et al. | |
| 6,446,665 | B2 | 9/2002 | Coscarella | |
| 6,547,007 | B2 | 4/2003 | Szarka et al. | |
| 6,568,470 | B2 | 5/2003 | Goodson, Jr. et al. | |
| 6,957,703 | B2 | 10/2005 | Trott et al. | |
| 7,063,156 | B2 * | 6/2006 | Patel | E21B 34/12 166/332.8 |
| 7,299,880 | B2 | 11/2007 | Logiudice et al. | |
| 7,360,600 | B2 | 4/2008 | MacDougall et al. | |
| 7,665,528 | B2 | 2/2010 | Ross et al. | |
| 8,607,811 | B2 | 12/2013 | Korkmaz | |
| 8,893,796 | B2 | 11/2014 | Conner et al. | |
| 8,955,543 | B2 | 2/2015 | Groesbeck et al. | |
| 9,163,479 | B2 | 10/2015 | Rogers et al. | |
| 10,619,448 | B1 | 4/2020 | Watson et al. | |
| 2001/0023706 | A1 | 9/2001 | Coscarella | |
| 2003/0121665 | A1 | 7/2003 | Trott | |
| 2004/0031534 | A1 | 2/2004 | Schwartz | |
| 2004/0060704 | A1 | 4/2004 | Layton et al. | |
| 2007/0137869 | A1 | 6/2007 | MacDougall et al. | |
| 2010/0139923 | A1 | 6/2010 | Biddick | |
| 2010/0212907 | A1 | 8/2010 | Frazier | |
| 2011/0088908 | A1 * | 4/2011 | Xu | E21B 34/10 166/332.8 |
| 2011/0174505 | A1 | 7/2011 | Gill et al. | |
| 2011/0290344 | A1 * | 12/2011 | Groesbeck | E21B 34/16 137/430 |
| 2012/0305257 | A1 * | 12/2012 | Conner | E21B 21/10 166/323 |
| 2012/0321446 | A1 | 12/2012 | Blewett et al. | |
| 2014/0020904 | A1 | 1/2014 | Hill, Jr. | |
| 2015/0136404 | A1 | 5/2015 | Groesbeck et al. | |
| 2015/0211333 | A1 | 7/2015 | Vick, Jr. et al. | |
| 2016/0138365 | A1 | 5/2016 | Vick, Jr. et al. | |
| 2016/0138368 | A1 | 5/2016 | Girola | |
| 2016/0230503 | A1 * | 8/2016 | Holmberg | E21B 34/10 |
| 2016/0281465 | A1 | 9/2016 | Grayson et al. | |
| 2016/0341002 | A1 * | 11/2016 | McKitrick, III | E21B 34/14 |
| 2017/0175488 | A1 | 6/2017 | Lisowski et al. | |
| 2017/0370186 | A1 | 12/2017 | Stair | |
| 2018/0058177 | A1 | 3/2018 | Bigrigg et al. | |
| 2018/0209246 | A1 | 7/2018 | Miller et al. | |
| 2018/0334833 | A1 | 11/2018 | Brewer | |
| 2018/0334883 | A1 | 11/2018 | Williamson | |
| 2018/0347301 | A1 * | 12/2018 | Hilliard | E21B 34/10 |
| 2019/0003286 | A1 | 1/2019 | Bigrigg et al. | |
| 2019/0331235 | A1 | 10/2019 | Prather et al. | |
| 2019/0338620 | A1 | 11/2019 | Burris et al. | |
| 2020/0190941 | A1 | 6/2020 | Watson et al. | |

FOREIGN PATENT DOCUMENTS

| | | | |
|---|---|---|---|
| EP | 2535504 | A1 | 12/2012 |
| EP | 3561220 | A1 | 10/2019 |
| WO | 2004031534 | A1 | 4/2004 |
| WO | 2006024811 | A1 | 3/2006 |
| WO | 2007073401 | A1 | 6/2007 |
| WO | 2007125335 | A1 | 11/2007 |
| WO | 2017052556 | A1 | 3/2017 |

OTHER PUBLICATIONS

International Search Report and Written Opinion for International Application No. PCT/US2021/034166; International Filing Date May 26, 2021; dated Aug. 27, 2021 (pp. 1-11).

International Search Report and Written Opinion for International Application No. PCT/US2021/034170; International Filing Date May 26, 2021; dated Aug. 27, 2021 (pp. 1-11).

International Search Report and Written Opinion for International Application No. PCT/US2021/034167; International Filing Date May 26, 2021; dated Sep. 14, 2021 (pp. 1-10).

International Search Report and Written Opinion for International Application No. PCT/US2021/034168; International Filing Date May 26, 2021; dated Sep. 3, 2021 (pp. 1-11).

International Search Report and Written Opinion for International Application No. PCT/US2021/034173; International Filing Date May 26, 2021; dated Sep. 16, 2021 (pp. 1-10).

International Search Report and Written Opinion for International Application No. PCT/US2021/034174; International Filing Date May 26, 2021; dated Aug. 30, 2021 (pp. 1-10).

International Search Report and Written Opinion for International Application No. PCT/US2021/034175; International Filing Date May 26, 2021; dated Sep. 16, 2021 (pp. 1-11).

* cited by examiner

LOCKING BACKPRESSURE VALVE

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed, and a production string is run downhole to begin production. Withdrawing and running-in strings including drill strings and production strings is a time consuming and costly process. The industry would be open to systems that would reduce costs and time associated with plug removal and resource production.

SUMMARY

Disclosed is a downhole tool including a tubular having an outer surface and an inner surface defining a flowbore having a longitudinal axis, and a backpressure valve cartridge arranged in the flowbore. The backpressure valve cartridge includes a valve seat and a flapper valve pivotally mounted relative to the valve seat. The backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration.

Also disclosed is a resource exploration and recovery system including a first system, and a second system including at least one tubular extending into a formation. The at least one tubular supports a downhole tool including a tubular having an outer surface and an inner surface defining a flowbore having a longitudinal axis, and a backpressure valve cartridge arranged in the flowbore. The backpressure valve cartridge includes a valve seat and a flapper valve pivotally mounted relative to the valve seat. The backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration.

Further disclosed is a method of operating a backpressure valve including shifting a backpressure valve cartridge including a valve seat and a flapper valve along a longitudinal axis of a flowbore causing the flapper valve to transition from a first position, wherein the flapper valve rests on the valve seat to a second position, wherein the flapper valve is pivoted away from the valve seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
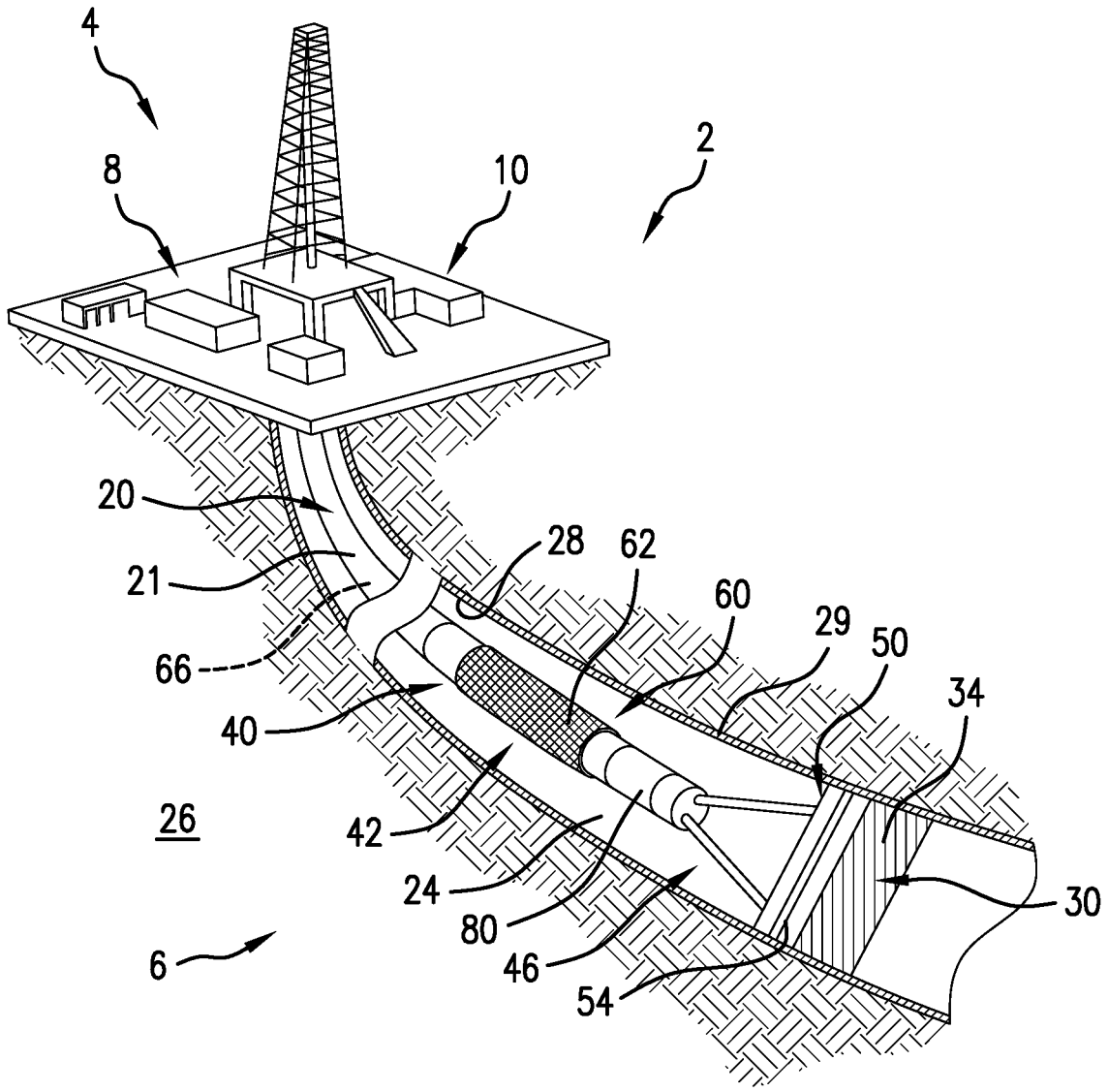
FIG. 1 depicts a resource exploration and recovery system including a locking backpressure valve, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which takes the form of a surface system operatively connected to a second system 6 which takes the form of a subsurface or subterranean system. First system 4 may include pumps 8 that aid in completion and/or extraction processes as well as fluid storage 10. Fluid storage 10 may contain a gravel pack fluid or slurry, or drilling mud (not shown) or other fluid which may be introduced into second system 6.

Second system 6 may include a downhole string 20 formed from one or more tubulars such as indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, subsurface system 6 may include a downhole zonal isolation device 30 that may form a physical barrier between one portion of wellbore 24 and another portion of wellbore 24. Downhole zonal isolation device 30 may take the form of a bridge plug 34. Of course, it is to be understood that zonal isolation device 30 may take on various forms including frac plugs formed from composite materials and/or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Plug removal and production system 42 includes a selective sand screen 60 arranged uphole of BHA 46. Selective sand screen 60 includes a screen element 62 that is arranged over a plurality of openings (not shown) formed in drill string 40. It is to be understood that the number of screen elements may vary. Further, it is to be understood that screen opening size may vary. It is also to be understood that screen element 62 may include a number of screen layers. The openings in drill string 40 fluidically connect wellbore 24 with a flow path 66 extending through drill string 40.

Figure 2:
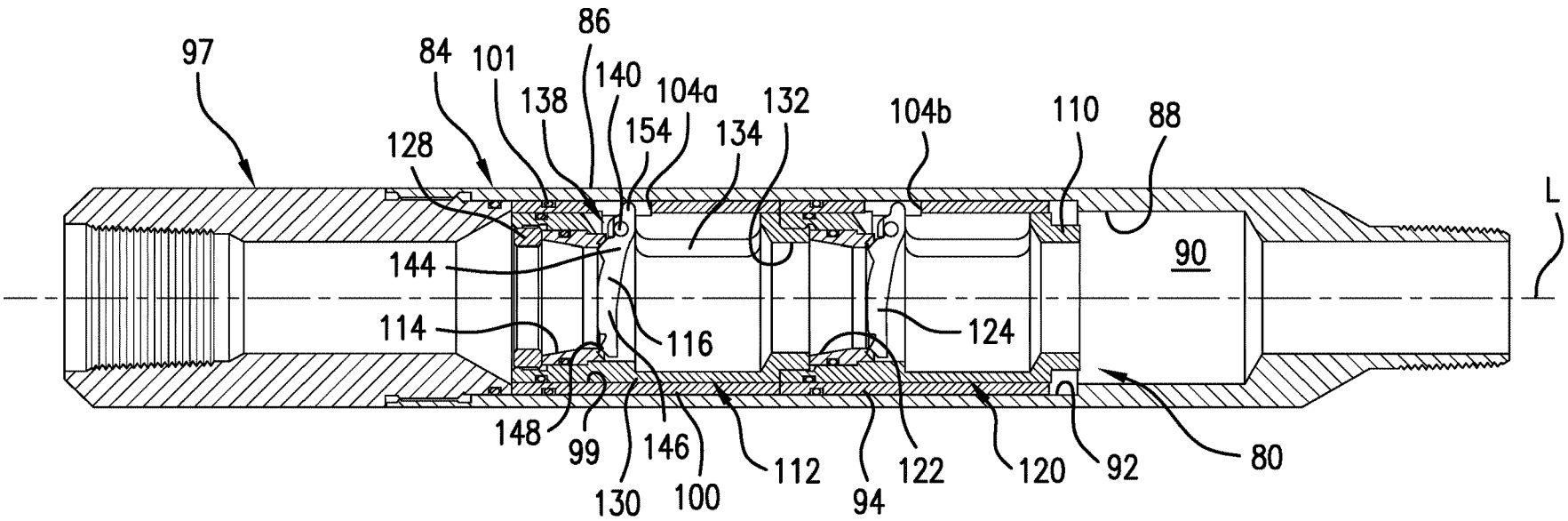
FIG. 2 depicts a cross-sectional side view of the locking backpressure valve in a run-in configuration, in accordance with an exemplary aspect.

In yet still further accordance with an exemplary embodiment, plug removal and production system 42 includes a backpressure valve (BPV) 80 arranged downhole of selective sand screen 60 and uphole of BHA 46. Referring to FIG. 2, BPV 80 includes a tubular 84 that forms part of drill string 40. Tubular 84 includes an outer surface 86 and an inner surface 88 that defines a flowbore 90 having a longitudinal axis "L" that receives BPV 80. Inner surface 88 includes a recessed section 92 that supports a stationary sleeve 94. Tubular 84 is shown to include a connector 97 that may be removed to provide access to flowbore 90.

In an embodiment, stationary sleeve 94 includes an inner surface portion 99 and an outer surface portion 100. Outer surface portion 100 includes one or move seal grooves (not separately labeled) that receive seals, such as shown at 101, that engage inner surface 88 of tubular 84. Stationary sleeve 94 includes a first pocket 104*a* and a second pocket 104*b* that extend through inner surface portion 99 to outer surface portion 100. Pockets 104*a* and 104*b* facilitate operation of BPV 80 as will be detailed herein.

In accordance with an exemplary aspect, BPV 80 includes a backpressure cartridge (BPC) 110 including a first valve portion 112 including a first valve seat 114 and a first flapper valve 116 and a second valve portion 120 having a second valve seat 122 and a second flapper valve 124. First valve portion 112 may be connected to second valve portion 120 through a plurality of threads (not separately labeled). A lock ring 128 may be employed to secure valve seat 114 against first valve portion 112. Reference will now follow to first valve portion 112 with an understanding that second valve portion 120 includes similar structure.

Figure 3:
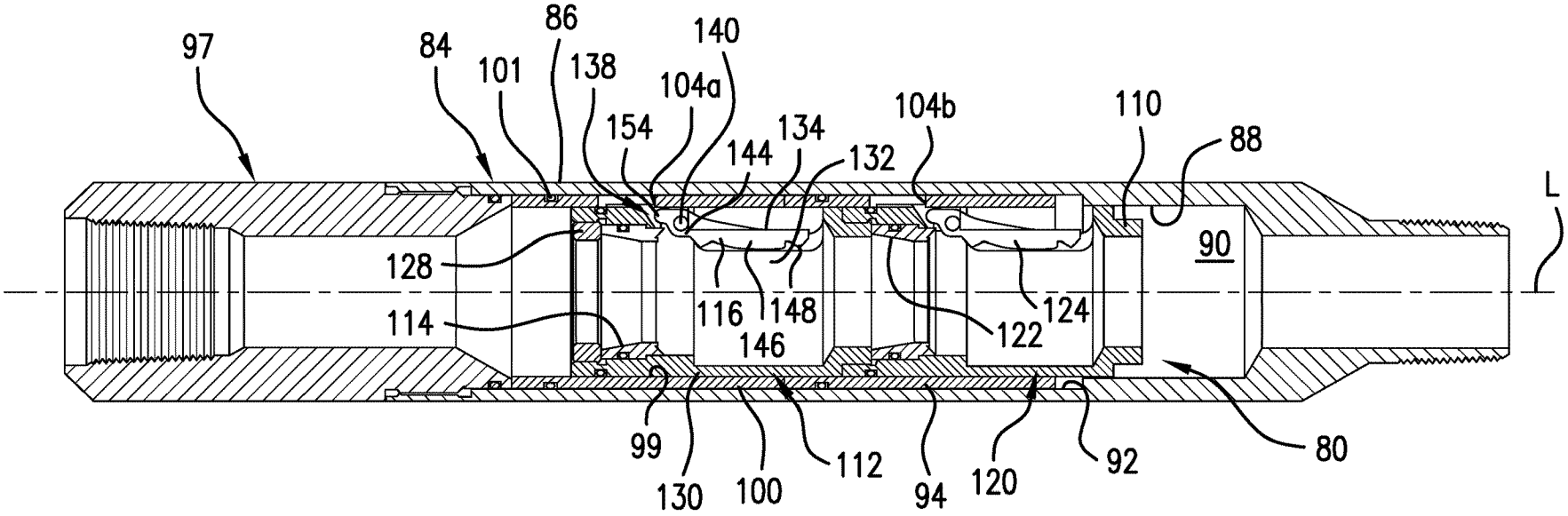
FIG. 3 depicts a cross-sectional side view of the locking backpressure valve in a production configuration, in accordance with an exemplary aspect.

First valve portion 112 includes an outer surface section 130 and an inner surface section 132, and an opening 134. Opening 134 is selectively receptive of first flapper valve 116. First valve portion 112 includes a hinge 138 that receives a hinge pin 140 that pivotally supports first flapper valve 116. In further accordance with an exemplary aspect, first flapper valve 116 includes a hinge portion 144 and a valve portion 146 having a sealing surface 148. Hinge portion 144 is also shown to include a tang element 154 that extends into pocket 104*a*. As will be detailed herein, BPC 110 may be shifted along the longitudinal axis "L" within flowbore 90 to shift first flapper valve 116 and second flapper valve 124 between a first or closed position as shown in FIG. 2 and a second position or open position as shown in FIG. 3.

In an embodiment, after mill 54 opens a downhole most plug (not shown), BHA 46 may be pumped off and allowed to fall and collect at a toe (not shown) of wellbore 24. During drilling, BPC 110 is arranged in the first position (FIG. 2) whereby first flapper valve 16 and second flapper valve 124 are free to pivot in first valve portion 112 and second valve portion 120 respectively. In this manner, drilling fluids may pass downhole toward BHA 46 but pressure may not pass uphole beyond BPV 80. That is, pressure moving in an uphole direction would act against and cause first flapper valve 116 and second flapper valve 124 to close.

After pumping off BHA 46, it may be desirable to produce fluids through drill string 40. As such, BPV 80 is moved to the second position (FIG. 3) opening flowbore 90. BPC 110 may be shifted along the longitudinal axis "L" causing tang element 154 to engage stationary sleeve 94 and shift first flapper valve 116 to the open position. Second flapper valve 124 operates in a similar manner. BPC 110 may be shifted through a variety of mechanisms including shifting tools, fluid pressure (annular and/or tubular) and drop balls. During production, it may be desirable to lock BPC 110 in the second position to ensure that flowbore 90 remains open.

Figure 4:
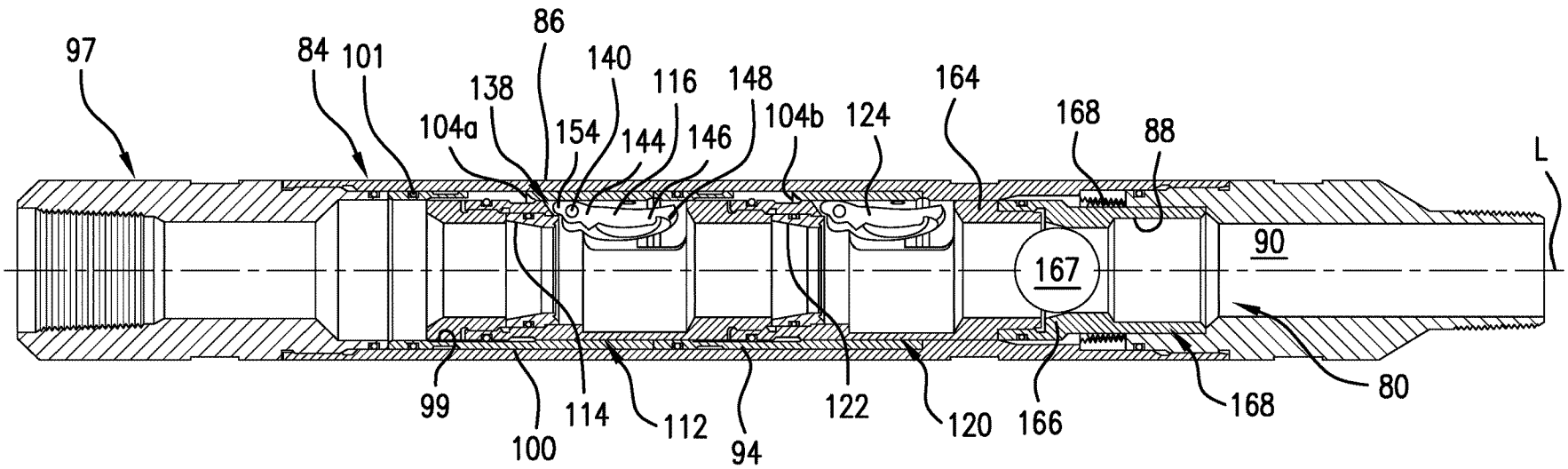
FIG. 4 depicts a cross-sectional side view of a locking backpressure valve including a locking system positioned in a locked configuration, in accordance with an exemplary aspect.

In an exemplary aspect shown in FIG. 4, wherein like reference numbers represent corresponding parts in the respective views, BPC 110 includes a locking mechanism 164 that is connected to second valve portion 120. Locking mechanism 164 includes an object seat, such as a ball seat 166 that may be receptive of an object such as a drop ball 167 employed to facilitate shifting BPC 110 to the second position and a body lock ring 168. Body lock ring 168 includes first and second ring members (not separately labeled) each having corresponding tooth elements (also not separately labeled). The tooth elements may be angled to allow axial moving in one direction while resisting axial movement in an opposite direction. Thus, after shifting to the second position, locking mechanism 164 maintains first and second flapper valves 116 and 124 in the open configuration. At this point, while described as a drop ball, it should be understood that the object may take on various forms including balls, darts, plugs and the like.

Figure 5:
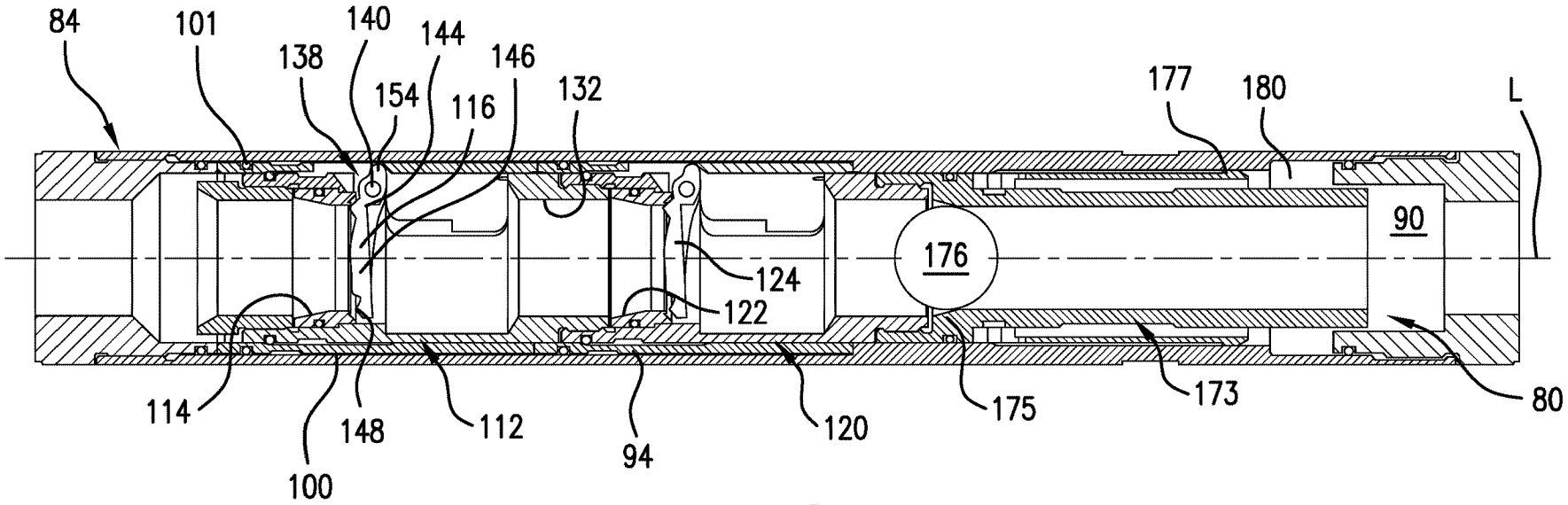
FIG. 5 depicts a cross-sectional side view of a locking backpressure valve including a locking system positioned in an un-locked configuration, in accordance with another exemplary aspect.
Figure 6:
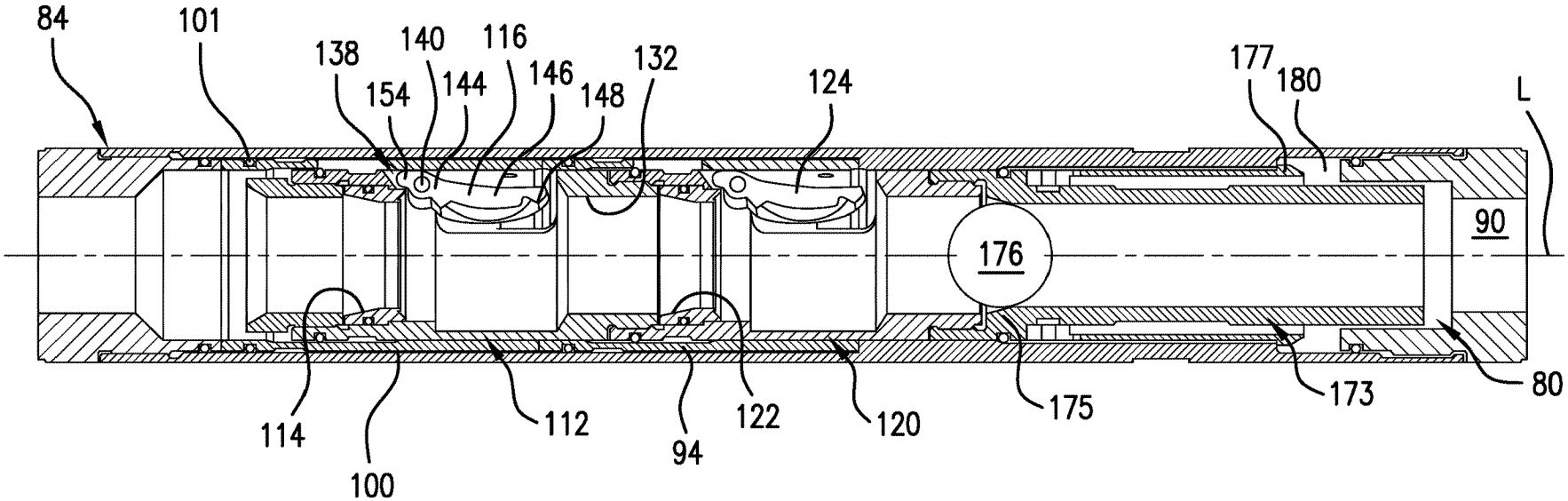
FIG. 6 depicts a cross-sectional side view of the locking backpressure valve of FIG. 5 showing the locking system positioned in a locked configuration, in accordance with an exemplary aspect.

Reference will now follow to FIGS. 5 and 6, wherein like reference numbers represent corresponding parts in the respective views, in describing a locking mechanism 173 in accordance with an exemplary aspect. Locking mechanism 173 is connected to second valve portion 120 and may include a ball seat 175 that receives a drop ball 176. Locking mechanism 173 may also include one or more collet fingers such as shown at 177 that shift along with BPC 110 from the first position (FIG. 5) to the second position (FIG. 6) in which collet fingers 177 snap into a recess 180 formed in inner surface 88 thereby locking first flapper valve 116 and second flapper valve 124 in the open configuration.

Figure 7:
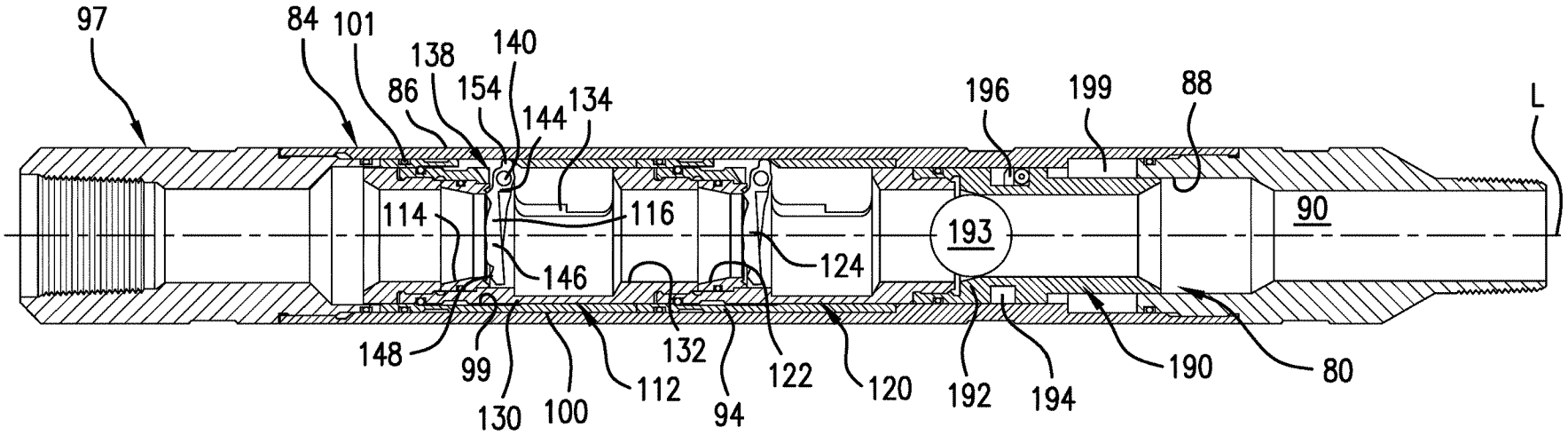
FIG. 7 depicts a cross-sectional side view of a locking backpressure valve including a locking system positioned in an un-locked configuration, in accordance with still another exemplary aspect.
Figure 8:
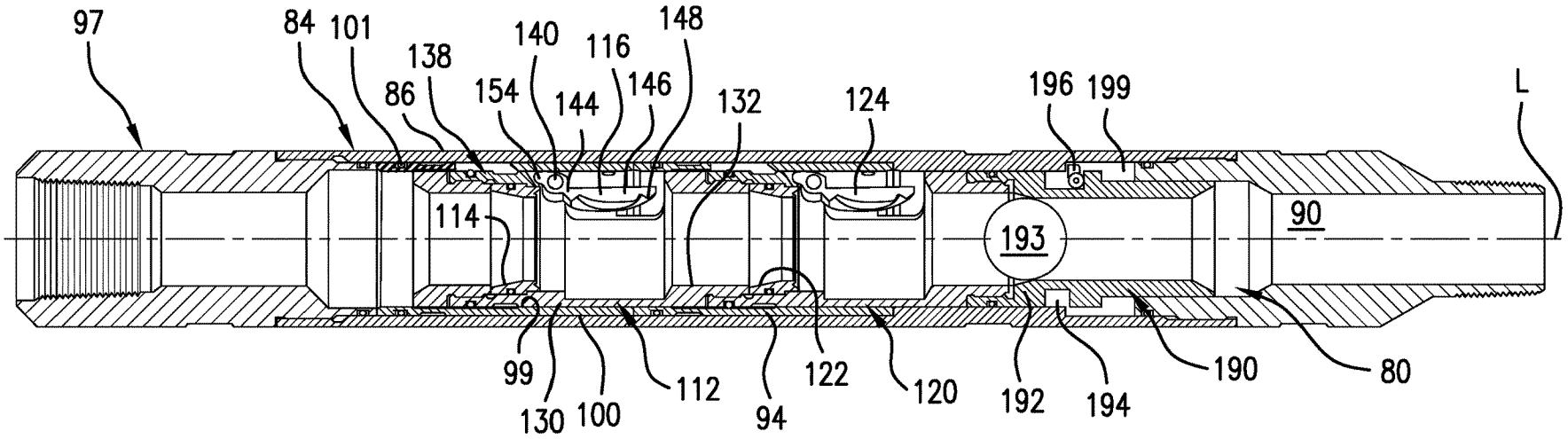
FIG. 8 depicts a cross-sectional side view of the locking backpressure valve of FIG. 7 showing the locking system positioned in a locked configuration, in accordance with an exemplary aspect.

Reference will now follow to FIGS. 7 and 8, wherein like reference numbers represent corresponding parts in the respective views, in describing a locking mechanism 190 in accordance with an exemplary aspect. Locking mechanism 190 is connected to second valve portion 120 and may include an object seat, such as a ball seat 192 that receives a drop ball 193. Locking mechanism 190 may also include an annular recess 194 that is receptive of a radially expandable dog 196. BPC 110 may be shifted from the first position (FIG. 7) by pressuring up against drop ball 193 to the second position (FIG. 8) in dog 196 expands radially outwardly into a groove 199 formed in inner surface 88 thereby locking first flapper valve 116 and second flapper valve 124 in the open configuration.

At this point it should be understood that the exemplary embodiments describe a system for actuating a backpressure valve by shifting a self-contained backpressure valve cartridge. The backpressure valve cartridge includes a valve portion having a valve seat and a flapper valve. The flapper valve may be shifted from one position to another position simply by moving the backpressure valve cartridge. A locking mechanism may be employed to lock the flapper valve in position after shifting. It should be understood that while shown as including two valve portions, backpressure valve cartridge may include any number of valves. Further, while shown as being shifted to open valves, it should be understood that the cartridge could also be shifted to close valves.

Set forth below are some embodiments of the foregoing disclosure:

Embodiment 1. A downhole tool comprising: a tubular having an outer surface and an inner surface defining a flowbore having a longitudinal axis; and a backpressure valve cartridge arranged in the flowbore, the backpressure valve cartridge including a valve seat and a flapper valve pivotally mounted relative to the valve seat, wherein the backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration.

Embodiment 2. The downhole tool according to any prior embodiment, further comprising: a stationary sleeve arranged in the flowbore and fixed relative to the inner surface.

Embodiment 3. The downhole tool according to any prior embodiment, wherein the stationary sleeve includes an inner surface portion including at least one pocket.

Embodiment 4. The downhole tool according to any prior embodiment, wherein the backpressure valve cartridge includes an inner surface section and an outer surface section and a hinge including a hinge pin that pivotally supports the flapper valve.

Embodiment 5. The downhole tool according to any prior embodiment, wherein the flapper valve includes a hinge portion receptive of the hinge pin and a valve portion including a sealing surface, the valve portion extending radially outwardly of the hinge portion.

Embodiment 6. The downhole tool according to any prior embodiment, wherein the flapper valve includes a tang element that projects radially outwardly of the hinge portion, the tang element being selectively received in the pocket.

Embodiment 7. The downhole tool according to any prior embodiment, wherein the backpressure valve cartridge includes a ball seat.

Embodiment 8. The downhole tool any prior embodiment, wherein the downhole tool includes a locking mechanism that secures the backpressure valve cartridge in the second position.

Embodiment 9. The downhole tool any prior embodiment, wherein the locking mechanism includes one or more collet fingers that are selectively radially outwardly biased to secure the backpressure valve cartridge in the second position.

Embodiment 10. The downhole tool any prior embodiment, wherein the locking mechanism includes a body lock ring.

Embodiment 11. The downhole tool any prior embodiment, wherein the locking mechanism includes a dog that is radially outwardly biased to secure the backpressure valve cartridge in the second position.

Embodiment 12. A resource exploration and recovery system comprising: a first system; a second system including at least one tubular extending into a formation, the at least one tubular supporting a downhole tool comprising: a tubular having an outer surface and an inner surface defining a flowbore having a longitudinal axis; and a backpressure valve cartridge arranged in the flowbore, the backpressure valve cartridge including a valve seat and a flapper valve pivotally mounted relative to the valve seat, wherein the backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration.

Embodiment 13. The resource exploration and recovery system any prior embodiment, further comprising: a stationary sleeve arranged in the flowbore and fixed relative to the inner surface, wherein the stationary sleeve includes an inner surface portion including at least one pocket.

Embodiment 14. The resource exploration and recovery system any prior embodiment, wherein the backpressure valve cartridge includes an inner surface section and an outer surface section and a hinge including a hinge pin that pivotally supports the flapper valve.

Embodiment 15. The resource exploration and recovery system according to any prior embodiment, wherein the flapper valve includes a hinge portion receptive of the hinge pin and a valve portion including a sealing surface, the valve portion extending radially outwardly of the hinge portion, the flapper valve further including a tang element that projects radially outwardly of the hinge portion, the tang element being selectively received in the pocket.

Embodiment 16. The resource exploration and recovery system according to any prior embodiment, wherein the downhole tool includes a locking mechanism that secures the backpressure valve cartridge in the second position.

Embodiment 17. The resource exploration and recovery system according to any prior embodiment, wherein the locking mechanism includes one or more collet fingers that are selectively radially outwardly biased to secure the backpressure valve cartridge in the second position.

Embodiment 18. The resource exploration and recovery system according to any prior embodiment, wherein the locking mechanism includes a body lock ring.

Embodiment 19. The resource exploration and recovery system according to any prior embodiment, wherein the locking mechanism includes a dog that is radially outwardly biased to secure the backpressure valve cartridge in the second position.

Embodiment 20. A method of operating a backpressure valve comprising: shifting a backpressure valve cartridge including a valve seat and a flapper valve along a longitudinal axis of a flowbore causing the flapper valve to transition from a first position, wherein the flapper valve rests on the valve seat to a second position, wherein the flapper valve is pivoted away from the valve seat.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular having an outer surface and an inner surface defining a flowbore having a longitudinal axis;

a backpressure valve cartridge arranged in the flowbore, the backpressure valve cartridge including a valve seat and a flapper valve pivotally mounted relative to the valve seat, wherein the backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration; and a stationary sleeve arranged in the flowbore and fixed relative to the inner surface.

2. The downhole tool according to claim 1, wherein the stationary sleeve includes an inner surface portion including at least one pocket.

3. The downhole tool according to claim 2, wherein the backpressure valve cartridge includes an inner surface section and an outer surface section and a hinge including a hinge pin that pivotally supports the flapper valve.

4. The downhole tool according to claim 3, wherein the flapper valve includes a hinge portion receptive of the hinge pin and a valve portion including a sealing surface, the valve portion extending radially outwardly of the hinge portion.

5. The downhole tool according to claim 4, wherein the flapper valve includes a tang element that projects radially outwardly of the hinge portion, the tang element being selectively received in the pocket.

6. The downhole tool according to claim 1, wherein the backpressure valve cartridge includes a ball seat.

7. The downhole tool according to claim 1, wherein the downhole tool includes a locking mechanism that secures the backpressure valve cartridge in the second position.

8. The downhole tool according to claim 7, wherein the locking mechanism includes one or more collet fingers that are selectively radially outwardly biased to secure the backpressure valve cartridge in the second position.

9. The downhole tool according to claim 7, wherein the locking mechanism includes a body lock ring.

10. The downhole tool according to claim 7, wherein the locking mechanism includes a dog that is radially outwardly biased to secure the backpressure valve cartridge in the second position.

11. A resource exploration and recovery system comprising:

a first system;

a second system including at least one tubular extending into a formation, the at least one tubular supporting a downhole tool comprising:

a tubular having an outer surface and an inner surface defining a flowbore having a longitudinal axis;

a backpressure valve cartridge arranged in the flowbore, the backpressure valve cartridge including a valve seat and a flapper valve pivotally mounted relative to the valve seat, wherein the backpressure valve cartridge is shiftable along the longitudinal axis to shift the flapper valve between a first position, wherein the flapper valve is free to pivot relative to the valve seat, and a second position, wherein the flapper valve is pivoted away from the valve seat and maintained in an open configuration; and a stationary sleeve arranged in the flowbore and fixed relative to the inner surface.

12. The resource exploration and recovery system according to claim 11, wherein the stationary sleeve includes an inner surface portion including at least one pocket.

13. The resource exploration and recovery system according to claim 12, wherein the backpressure valve cartridge includes an inner surface section and an outer surface section and a hinge including a hinge pin that pivotally supports the flapper valve.

14. The resource exploration and recovery system according to claim 13, wherein the flapper valve includes a hinge portion receptive of the hinge pin and a valve portion including a sealing surface, the valve portion extending radially outwardly of the hinge portion, the flapper valve further including a tang element that projects radially outwardly of the hinge portion, the tang element being selectively received in the pocket.

15. The resource exploration and recovery system according to claim 11, wherein the downhole tool includes a locking mechanism that secures the backpressure valve cartridge in the second position.

16. The resource exploration and recovery system according to claim 15, wherein the locking mechanism includes one or more collet fingers that are selectively radially outwardly biased to secure the backpressure valve cartridge in the second position.

17. The resource exploration and recovery system according to claim 15, wherein the locking mechanism includes a body lock ring.

18. The resource exploration and recovery system according to claim 15, wherein the locking mechanism includes a dog that is radially outwardly biased to secure the backpressure valve cartridge in the second position.

19. A method of operating a backpressure valve arranged in a tubular having an inner surface defining a flowbore, the method comprising:

shifting a backpressure valve cartridge including a valve seat and a flapper valve along a longitudinal axis of the flowbore along a stationary sleeve fixedly connected to the inner surface causing the flapper valve to transition from a first position, wherein the flapper valve rests on the valve seat to a second position, wherein the flapper valve is pivoted away from the valve seat; and locking the flapper valve in the second position with one or more collet fingers that snap into a recess formed in the inner surface downhole of the flapper valve and the stationary sleeve.

* * * * *